United States Patent [19]

Chandley et al.

[11] Patent Number: 4,754,798

[45] Date of Patent: Jul. 5, 1988

[54] CASTING METAL IN A FLOWABLE FIRMLY SET SAND MOLD CAVITY

[75] Inventors: George D. Chandley; Rodney G. Riek, both of Amherst, N.H.

[73] Assignee: Metal Casting Technology, Inc., Milford, N.H.

[21] Appl. No.: 96,663

[22] Filed: Sep. 15, 1987

[51] Int. Cl.[4] ..... B22C 9/04

[52] U.S. Cl. ..... 164/35; 164/516

[58] Field of Search ..... 164/34, 35, 516, 517, 164/518

[56] References Cited

U.S. PATENT DOCUMENTS

| | | |
|---|---|---|
| 2,948,935 | 8/1960 | Carter . |
| 3,396,775 | 8/1968 | Scott . |
| 3,422,880 | 1/1969 | Brown . |
| 4,085,790 | 4/1978 | Wittmoser . |
| 4,293,480 | 10/1981 | Martin . |
| 4,352,914 | 10/1982 | Tobinagu . |
| 4,448,235 | 5/1984 | Bishop . |
| 4,451,577 | 5/1984 | Coss . |
| 4,482,000 | 1/1984 | Reuter . |
| 4,543,373 | 9/1985 | Krawiec . |
| 4,615,372 | 10/1986 | Kopac . |
| 4,616,689 | 10/1986 | Denis . |

*Primary Examiner*—Kuang Y. Lin

[57] ABSTRACT

The sand-binder mixture in a sand casting mold is controlled so that it contains sufficient binder to enable it to set to form a mold, yet the resulting set mold is sufficiently porous to receive liquids and vapors from a disposable pattern and sufficiently rigid to retain the pattern shape after the pattern is removed. At the proper binder loading, the mold has porosity such that the pattern will evacuate the cavity prior to casting when heated at relatively low temperatures (well below pattern combustion temperatures) that do not harmfully affect the mold and do not necessarily remove all of the pattern material from the mold. Thus, the pattern is removed from the mold cavity, before the molten metal is added, by heating the pattern and mold to cause the pattern to become fluid and to flow both into the sand mold and out of openings in it, without the need for high temperature combustion. The molten metal is then added to the cavity, and allowed to solidify before it is removed.

8 Claims, 2 Drawing Sheets

Place pattern in box

↓

Flow sand binder mixture around the pattern

↓

Set the mixture to form a porous mold

↓

Heat to drive pattern Material out of and into The mold forming a cavity

↓

Fill cavity with molten metal

↓

Solidify metal

↓

Remove cast metal from mold

FIG 1

CASTING METAL IN A FLOWABLE FIRMLY SET SAND MOLD CAVITY

This invention relates to casting metal objects in a sand mold.

There are various ways to cast molten metal in sand molds.

One process is known generally as the "lost foam process", in which a pattern is formed from a vaporizable material (e.g. foam). Loose (unbound) flowing sand is packed around the material, and molten metal is poured directly on the foam, vaporizing it and leaving solidified metal in place of the pattern. Because the pattern is vaporized as the metal is poured, there is no need for rigidity in the sand mold. The pattern must be low density, to reduce the volume of vapor created during the process. Exemplary patents disclosing the "lost foam process" include: Wittmoser, U.S. Pat. Nos. 4,085,790; Bishop, 4,448,235; Reuter, 4,482,000; Denis, 4,616,689. Various problems may be encountered with the lost foam process, including a rough surface on the cast metal and gas inclusions in the part from pattern decomposition products.

Another casting technigue involves use of a denser pattern (e.g. wax) in a mold that is rigid and relatively non-porous. Typically, much of the wax pattern is removed by autoclaving the pattern, e.g. around 350° F. Residual pattern material remains in the mold, and must be removed at extremely high temperatures to avoid carbon inclusions in the cast workpiece. Such molds require a relatively high level of refractory binder (over about 5%), to withstand the extremely high temperature (e.g. 1600° F.) necessary to remove (vaporize and combust) all the wax. See, e.g. Brown et al., U.S. Pat. Nos. 3,422,880, Scott, 3,396,775, and Carter, 2,948,935. The refractory-binder mixture may be invested around the pattern in layers forming a shell mold or by filling a container around the patterns, forming a block mold.

SUMMARY OF THE INVENTION

We have discovered that, by controlling the sand-binder mixture, an entirely new sand casting process is possible, using a disposable pattern of meltable material. The sand contains sufficient non-refractory binder to enable it to set to form a mold, yet the binder level is low enough to enable the sand to flow around the pattern. The resulting mold is sufficiently porous to receive and entrap pattern liquid and vaporous decomposition products and sufficiently rigid to retain the pattern shape after the pattern is removed. At the proper binder loading, the mold has porosity (e.g. over 30% and preferably over 45–50% of the mold volume is void) such that the pattern can be removed prior to casting at relatively low temperatures that do not affect the mold. Thus, the pattern is removed before the molten metal is added by heating the pattern to cause it to become fluid. Some pattern material flows out of openings and the rest, which is a significant percentage, flows or wicks into the sand mold where it is harmless, eliminating the need for high-temperature removal of pattern residues. At least 15% and preferably much more (e.g. over 50%) of the pattern material in the work piece cavity wicks into and remains within the sand mixture. The cavity is then filled with molten metal and allowed to solidify in normal fashion.

Preferred embodiments include the following features. The pattern is constructed from a polymeric material comprising wax, foam, or plastic. During heating of the pattern, the portion of the mold that will be positioned on top when filling with the molten metal is positioned on bottom to facilitate upward venting of the decomposition products during the addition of molten metal to the cavity. The molten metal may be suctioned against gravity or poured into the cavity formed by pattern removal.

The method is relatively low-cost, in part because the sand can be flowed around the form in a relatively simple operation such as a vibration. Moreover, the sand can be reclaimed and the amount of binder used is relatively low, also reducing costs. The method provides high quality parts, avoiding inclusions from decomposition products that often boil up through the metal in the lost foam process. Complex shapes can be formed without use of separate sand cores. The method can be used with relatively complex patterns because the mold does not lose its shape, as may happen with the lost foam process. Even with complex patterns, the sand can be flowed around the part by rotating the mold to access portions that are not easily accessed in a given orientation. The method can be used with smooth wax or plastic patterns, providing a much smoother surface than is possible with expanded foam patterns. The method also enables relatively easy removal of the metal part from the mold because the mold is rather weak.

Other features and advantages of the invention will be apparent from the following description of a preferred embodiment thereof and from the claims.

DESCRIPTION OF A PREFERRED EMBODIMENT

DRAWINGS

FIG. 1 is a flow diagram of a preferred method of casting.

FIGS. 2A–D are diagrammatic representations of a mold and pattern at different stages of the method.

Method

Figure 2A:
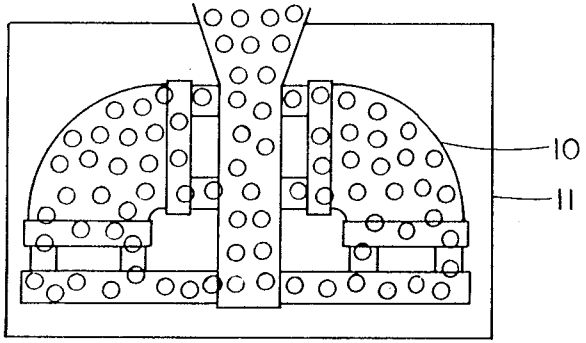

In FIG. 2A, pattern 10 is positioned in a box 11. Pattern 10 can be manufactured from a variety of known pattern materials, including wax, plastic, or expanded foam, using known techniques. Wax is particularly suitable. One suitable wax material is KC-610, sold by Kindt-Collins Co.

Figure 2B:
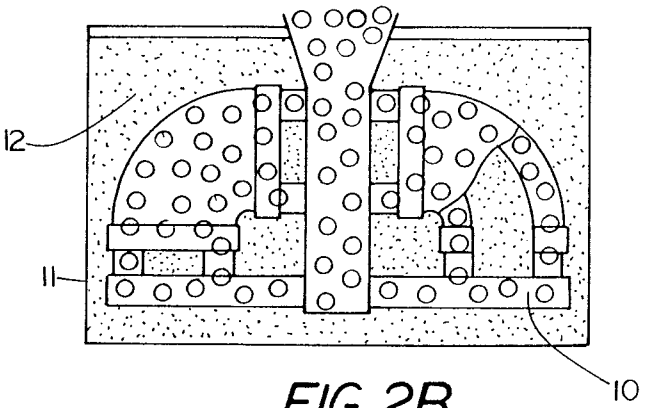

In FIG. 2B, a sand-binder mixture 12 has been positioned around pattern 10. Sand-binder mixture 12 comprises a sand suitable for casting (e.g. silica) as is well known in the field, coated with a binder. The binder can be any of a variety of foundry binders, e.g. organic binders, currently used for sand casting molds. For example standard phenolic urethane or phenol-formaldehyde resin modified with a curing agent can be used (U.S. Pat. Nos. 3,725,333; 4,148,177; and 4,311,631).

It is critical to the invention to control the amount of binder used. If too much binder is used, the sand-binder mixture will not flow readily around the pattern; moreover, too much binder will form a relatively imporous mold, which cannot serve as an adequate reservoir to entrap liquid and vapor from the pattern. In that case, pattern material remaining in the mold cavity may interfere with casting. Too much binder also hinders the process of removing the final work-piece from the mold.

On the other hand, if there is too little binder, the mold will not set with sufficient rigidity to maintain the cavity in the pattern configuration, leading to a poor quality work-piece.

Surprisingly, these conflicting requirements can be accomodated using a process that does not require mechanical stripping of the mold from permanent patterns, but that relies instead on wicking of a disposable pattern material which reflects the special porosity characteristics of a low-binder mold. We have found that the ratio of binder to sand should be in the range of 0.25% to 1% and most preferably about 0.4% to 0.7% as percents of sand weight. It is also possible to use dry, curable binders (e.g. methyl formate-cured binders) that can be flowed around the pattern and set by co-reaction. With the latter, higher loading percentages are possible.

Once the sand-binder mixture has flowed around the pattern, the mixture is set to form a rigid mold, e.g., by heating or curing methods appropriate for the binder selected. In general, the binder manufacturer will provide suitable instructions as to curing its product.

Figure 2C:
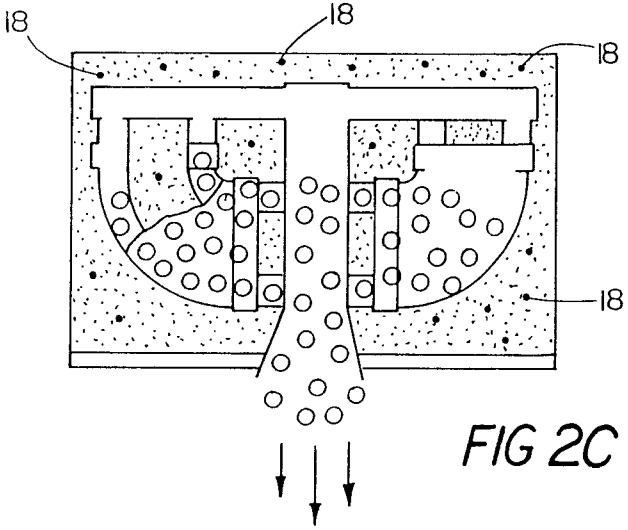

After the mold has set, the pattern is removed to form a cavity to receive molten metal. Two important features of the removal step are that: (a) removal takes place before the molten metal is added; and (b) removal is accomplished at a relatively low temperature that leaves substantial pattern material residue in the sand mold (not in the mold cavity). The pattern material must wick into the mold to a sufficient depth to avoid substantial blowing of vapor into the cavity during casting, which could result in gas inclusions in the work piece. Typically, as shown in FIG. 2C, while the pattern is being removed, the mold is inverted to allow some of the pattern material to run out of the pour cup as a liquid. The presence of pattern material in the sand mixture is shown in FIGS. 2C and 2D as dots 18.

We have determined that patterns are preferably removed at temperatures of 250°-500° F. Specifically wax patterns are removed using pressurized steam at 250°-450° F. Styrene and low melting foam should be removed at slightly higher temperatures (preferably 400°-500° F.). The mold cavity generally will be free from harmful pattern residues after a minimum of about 10 minutes at the above temperatures. These temperatures contrast sharply with the extremely high temperatures standardly used to remove wax from ceramic molds, e.g. 1600° F.

Figure 2D:
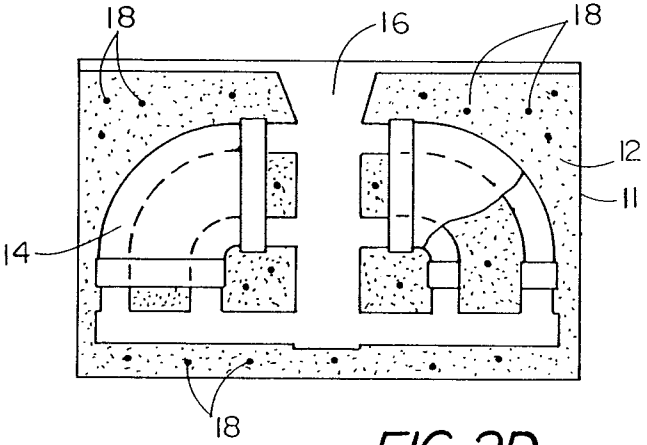

After the pattern material has been entirely driven from the cavity 14, the mold is available for casting molten metal, e.g. by gravity pouring as shown in FIG. 2D, or by counter-gravity vacuum as described in U.S. Pat. No. 3,900,064.

The molten metal enters the cavity (e.g. by pour cup 16 as shown in FIG. 2D) and the pattern configuration is retained by the mold's rigidity until the metal solidifies. Once the work piece has solidified, the mold is cracked open to remove it. It is particularly advantageous that the binder levels described above readily permit fragmentation of the mold without substantial risk of damage to the work piece. If desired, the mold pieces can be treated (e.g. with intense heat) to drive off binder and pattern material and recover the sand.

The above method is generally suitable for a wide range of pattern shapes and for a wide range of materials and products. Particularly useful applications include automotive engine parts, for example engine blocks and intake manifolds.

Other embodiments are within the following claims.

We claim:

1. A method of casting a metal object comprising:

(a) providing a disposable pattern of meltable material;

(b) positioning said pattern within a container;

(c) flowing a sand-binder mixture around said pattern, said mixture comprising non-refractory binder present at a level, (i) sufficiently high to enable said mold to set, (ii) sufficiently low to allow said mixture to flow freely around the pattern, (iii) sufficiently low to allow said mold to be readily removed from the casting subsequently formed therein, and (iv) sufficiently low to maintain at least 30% of mold porosity after setting;

(d) setting said sand-binder mixture;

(e) forming a cavity in place of the pattern by heating said pattern and mold at a temperature and under conditions which cause the pattern material to become fluid and to flow both into the set mixture and out of mold openings;

(f) thereafter, filling said cavity with molten metal;

(g) allowing said metal to solidify; and (h) removing said metal object from said mold.

2. The method of claim 1 wherein said pattern is wax, polymeric foam, or plastic.

3. The method of claim 1 wherein pattern and mold are heated (in step e) to a temperature of 250°-500° F.

4. The method of claim 1 wherein said binder is present at about 0.25-0.6% by weight of sand.

5. The method of claim 1 wherein said molten metal is suctioned against gravity into said cavity.

6. The method of claim 1 wherein, during the heating of the pattern, the portion of the mold that will be on bottom during the pattern removal (step e) is on top during the casting to facilitate venting of the pattern decomposition products from the mold.

7. The method of claim 6 wherein the mold includes an inlet into which molten metal is to be poured, and, during the heating of the pattern (step e), the mold is inverted to allow some of the pattern material to flow out.

8. The method of claim 1 wherein at least 15 percent of the pattern material is entrapped in the sand mixture mold during step f.

* * * * *